US007887053B2

(12) United States Patent
Smith et al.

(10) Patent No.: US 7,887,053 B2
(45) Date of Patent: Feb. 15, 2011

(54) PRINT INTERFACE SYSTEM FOR A SHEET HANDLING DEVICE

(75) Inventors: Aaron D. Smith, Beacon Falls, CT (US); Robert J. Allen, Shelton, CT (US); James A. Fairweather, Milford, CT (US); Neil F. Baldino, Sandy Hook, CT (US); Thomas M. Lyga, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 991 days.

(21) Appl. No.: 11/731,373

(22) Filed: Mar. 30, 2007

(65) Prior Publication Data

US 2008/0185770 A1 Aug. 7, 2008

Related U.S. Application Data

(60) Provisional application No. 60/899,558, filed on Feb. 5, 2007, provisional application No. 60/899,594, filed on Feb. 5, 2007.

(51) Int. Cl.
*B65H 39/10* (2006.01)

(52) U.S. Cl. ..... 271/303; 271/298; 271/176; 271/301; 271/65; 271/186

(58) Field of Classification Search ..... 271/303, 271/298, 176, 301, 65, 186
See application file for complete search history.

(56) References Cited

U.S. PATENT DOCUMENTS 4,956,678 A * 9/1990 Kiya et al. ..... 399/401
5,448,348 A * 9/1995 Azeta ..... 399/364
5,690,325 A * 11/1997 Morimoto ..... 271/65
5,868,387 A * 2/1999 Kida et al. ..... 271/304
6,585,258 B1 * 7/2003 Hirota et al. ..... 271/186
6,814,353 B1 * 11/2004 Kakuta et al. ..... 271/186
7,318,585 B2 * 1/2008 Soshiroda ..... 271/176
2004/0256790 A1 * 12/2004 Saito et al. ..... 271/186
2005/0067755 A1 * 3/2005 Ueda et al. ..... 271/65

FOREIGN PATENT DOCUMENTS

JP 62167165 A * 7/1987

* cited by examiner

*Primary Examiner*—Stefanos Karmis
*Assistant Examiner*—Prasad V Gokhale
(74) *Attorney, Agent, or Firm*—Brian A. Collins; Angelo N. Chaclas

(57) ABSTRACT

A print interface system including a printer integrated in combination with a sheet handling system such as a mailpiece inserter. The print interface system facilitates the handling of sheet material in various operating modes, including conventional printing, duplex printing, and mailpiece creation modes. The system includes a printer having multiple feed paths for printing on opposing face surfaces of a sheet material. One of the feed paths directs sheet material to a staging tray and another feed path directs sheet material to a downstream module of the sheet handling system. The system further includes a positionable diverter for directing sheet material to one of the feed paths and a sheet sensor for determining when a sheet of material has been directed along the feed path leading to the output tray. A controller is operative to alternately reposition the diverter from one of two positions. A first position directs sheet material to the staging tray following a first print operation, and a second position directs sheet material to the downstream module of the sheet handling system. The controller, furthermore, repositions the diverter following a threshold period of time from receipt of the staging signal issued by the sheet sensor.

20 Claims, 4 Drawing Sheets

PRINT INTERFACE SYSTEM FOR A SHEET HANDLING DEVICE

CROSS REFERENCE TO RELATED APPLICATIONS

This application claims the benefit of U.S. Provisional Patent Applications 60/899594 and 60/899558 which were filed on Feb. 5, 2007. The specification of each provisional application is hereby incorporated by reference.

TECHNICAL FIELD

The present invention relates to systems for integrating a printer with accessory equipment, and, more particularly, to a system for integrating a printer with a sheet handling device, such as a mailpiece inserter and, still more particularly, a system and method for developing an integrated print interface to perform special print operations, such as duplex or dual-sided printing.

BACKGROUND OF THE INVENTION

A mail insertion system or a "mailpiece inserter" is commonly employed for producing mailpieces intended for mass mail communications. Such mailpiece inserters are typically used by organizations such as banks, insurance companies and utility companies for producing a large volume of specific mail communications where the contents of each mailpiece are directed to a particular addressee. Also, other organizations, such as direct mailers, use mailpiece inserters for producing mass mailings where the contents of each mailpiece are substantially identical with respect to each addressee.

In many respects, a typical inserter system resembles a manufacturing assembly line. Sheets and other raw materials (i.e., a web of paper stock, enclosures, and envelopes) enter the inserter system as inputs. Various modules or workstations in the inserter system work cooperatively to process the sheets until a finished mail piece is produced. Typically, inserter systems prepare mail pieces by arranging preprinted sheets of material into a collation, i.e., the content material of the mail piece, on a transport deck. The collation of preprinted sheets may continue to a chassis module where additional sheets or inserts may be added based upon predefined criteria, e.g., an insert being sent to addressees in a particular geographic region. Subsequently, the collation may be folded and placed into envelopes. Once filled, the envelopes are closed, sealed, weighed, and sorted. A postage meter may then be used to apply postage indicia based upon the weight and/or size of the mail piece.

These inserters typically require the use of "preprinted" sheets which are presented to the various downstream devices by a feed module for subsequent processing. That is, a mailpiece job run is printed to produce an "ordered" stack of mailpiece content material which may be fed to the mailpiece inserter. Scan codes disposed in the margin of the first or last sheet of each mailpiece document provide the instructions necessary to process the mailpiece, i.e., whether additional inserts will be added, how the content material is to be folded (C-fold, Z-fold, etc.) and/or what size envelop will the content material be contained. To facilitate communication of these instructions, a user computer and a printing device are typically network-connected to the mailpiece inserter such that scan codes can be easily printed and interpreted.

More recently, printers have been integrated with mailpiece inserters so that mailpiece content material may be supplied "on-demand", and/or "just-in-time". Examples of inserters having integrated printers include the DI 900 and DI 950 mailpiece inserters manufactured by Pitney Bowes Inc., located in Stamford, Conn. While such integration facilitates the flow and handling of mailpiece content material, it is often desirable, if not essential, that the printers used in such mailpiece inserters be repairable, replaceable or interchangeable with other printers. For example, while the DI 900 and DI 950 inserters employ HP 4350 B&W and HP 4700 color printers, it may, over the course of many years of service, be desirable to substitute these printers with updated versions of the same or to replace these printers with those of other Original Equipment Manufactures (OEMs).

Inasmuch as the internal program code employed to control such printers is often proprietary/confidential to the OEM, or time consuming to modify, it has become increasingly important to develop an electromechanical interface between the printer and inserter which allows the printer to operate independently, while at the same time, operate harmoniously with the mailpiece inserter. That is, the printer must be operative to perform its various functions, including those required by the inserter, without modifying the internal program code of the base printer.

Examples of such program functions include the requirement to duplex print (dual-sided printing) and conventional printing to an upper stacking tray. With respect to the former, duplex printing produces unique requirements inasmuch as a diverter mechanism, typically used in conjunction with printer accessories (such as a stapler or collator), must be controlled to divert sheet material to the mailpiece inserter. That is, while the diverter is typically controlled by the internal printer program code, i.e., when an accessory is added, the diverter must now be controlled in accordance with a different set of algorithms to cooperate with the inserter. With respect to the latter, the printer must be controlled to send sheet material to a stacking tray when being operated as a conventional printing apparatus and to a downstream module of the inserter (typically referred to as the buffer/accumulator or input module) when being used to generate mailpieces.

A need, therefore, exists for a print interface system for a sheet handling system to facilitate various operating modes, including conventional printing, duplex printing, and mailpiece creation modes.

SUMMARY OF THE INVENTION

A print interface system is disclosed, including a printer integrated in combination with a sheet handling system such as a mailpiece inserter. The print interface system facilitates the handling of sheet material in various operating modes, including conventional printing, duplex printing, and mailpiece creation modes. The system includes a printer having multiple feed paths for printing on opposing face surfaces of a sheet material. One of the feed paths directs sheet material to a staging tray and another feed path directs sheet material to a downstream module of the sheet handling system. The system further includes a positionable diverter for directing sheet material to one of the feed paths and a sheet sensor for determining when a sheet of material has been directed along the feed path leading to the output tray. A controller is operative to alternately repositioning the diverter from one of two positions. A first position directs sheet material to the staging tray following a first print operation, and a second position directs sheet material to the downstream module of the sheet handling system. The controller, furthermore, repositions the diverter following a threshold period of time X from receipt of the staging signal issued by the sheet sensor.

BRIEF DESCRIPTION OF THE DRAWINGS

The accompanying drawings illustrate a presently preferred embodiment of the invention, and together with the general description given above and the detailed description given below, serve to explain the principles of the invention.

As shown throughout the drawings, like reference numerals designate like or corresponding parts.

BEST MODE TO CARRY OUT THE INVENTION

The inventive print interface system and control algorithms therefor are described in the context of a mailpiece inserter system, though the inventive interface system may be used in combination with any sheet handling device which requires printing "on-demand" or "on request". Further, the invention is described in the context of a DI 900 Model Mailpiece Inserter, i.e., a mailpiece creation system produced by Pitney Bowes Inc., located in Stamford, State of Conn., USA, though, the inventive subject matter may be employed in any mailpiece inserter and/or with any print manager software used in the printing/creation of mailpieces such as PBFirst®. PBFirst is a registered trademark of Pitney Bowes Inc. and is a software product for printing/producing mailpieces processed by a mailpiece inserter system. Moreover, while the print interface system and control algorithms thereof are intended for use in combination with printers of various makes and models, the printers described herein include the HP 4350 BW and HP 4700 Color printers manufactured by Hewlett Packard Company, located in Palo Alto, State of Calif., U.S.A.

Figure 1:
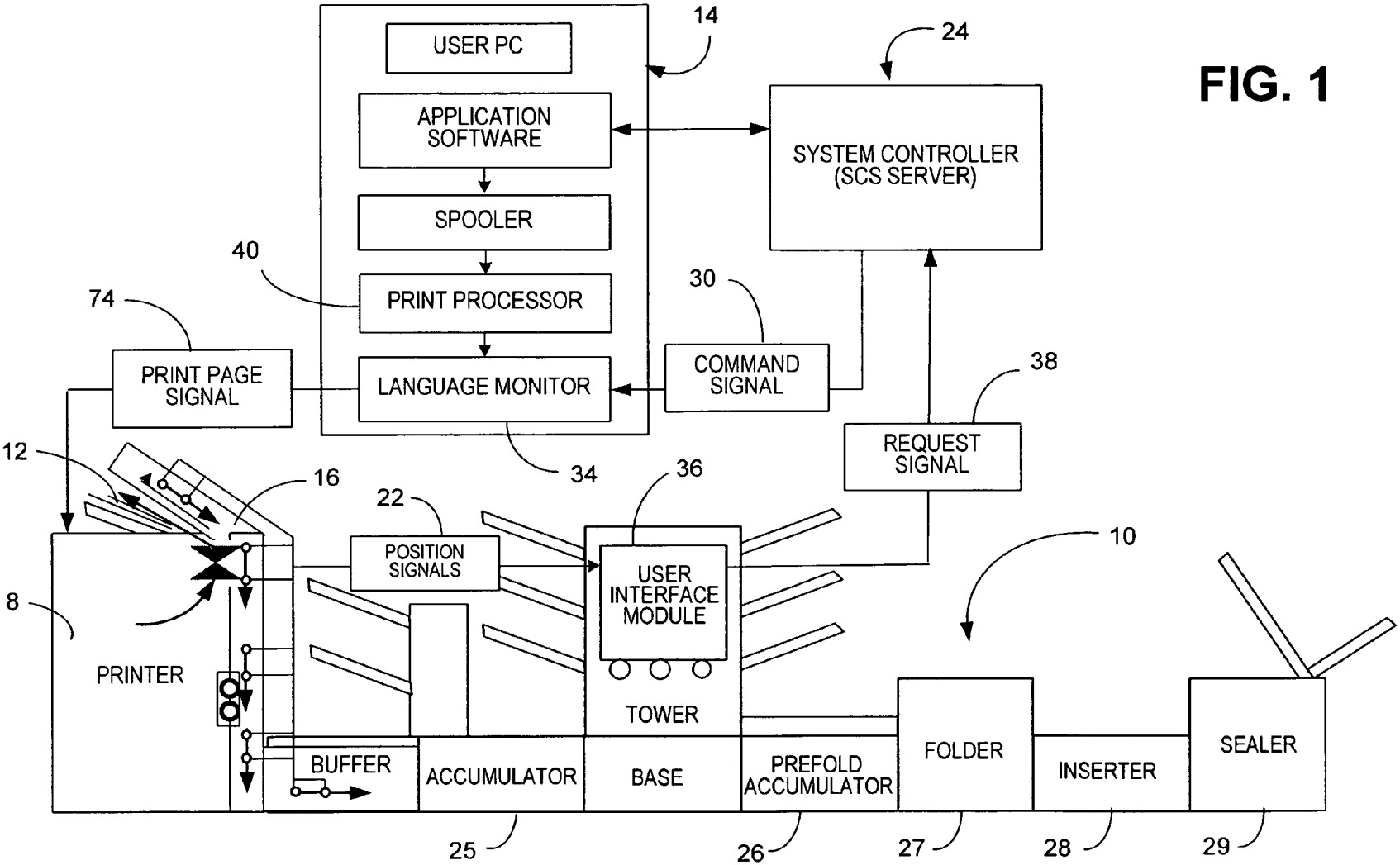
FIG. 1 is a schematic diagram of a mailpiece inserter having a printer integrated upstream of the various mailpiece handling/processing modules, i.e., a mechanical page buffer/accumulator, folder, inserter, and sealer.

Before discussing the invention in greater detail, it will be useful to understand the basic system architecture and operation of the mailpiece inserter, including the cooperation of various system components and elements. In FIG. 1, a dedicated printer 8 is integrated with the mailpiece inserter 10 and is disposed upstream of various inserter devices (also referred to as downstream devices relative to the printer 8) which handle and process the mailpiece content material 12. Throughout the description, the terms "mailpiece content material", "printed material", "sheets" and/or "sheet material" will used interchangeably. In the described embodiment, an HP 4350 and HP 4700 model printer, manufactured by Hewlett Packard (HP), is integrated with the mailpiece inserter 10. The HP 4350 printer system is a black & white printer having an output rate of approximately fifty-five (55) pages per minute. The HP 4700 is a color printer having an output rate of approximately thirty (30) pages per minute.

Figure 2:
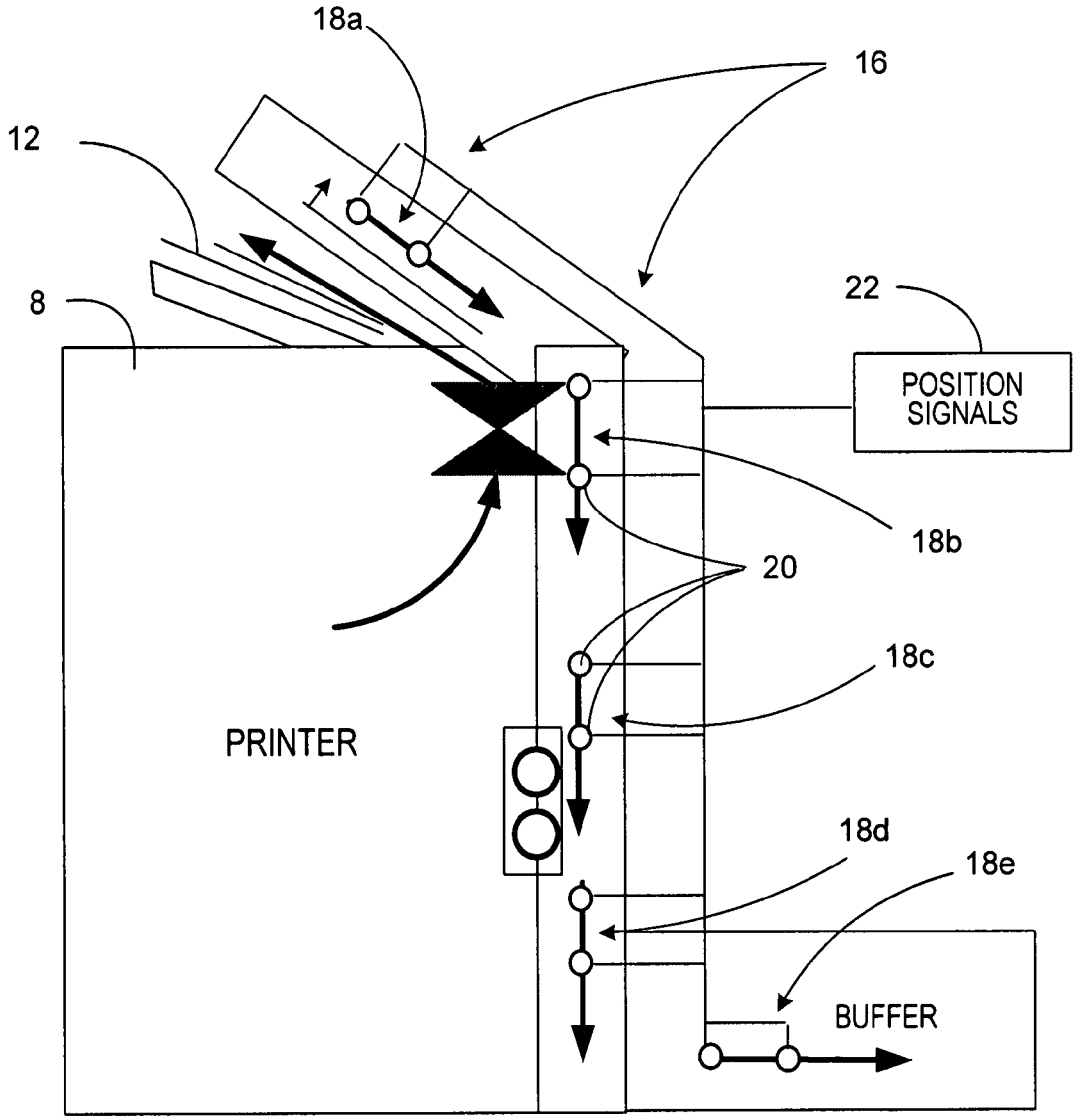
FIG. 2 is an enlarged schematic diagram of a mechanical printed-page buffer which senses the throughput status of mailpiece content material prior to downstream processing by the inserter.

In FIGS. 1 and 2, a mechanical buffer or page buffer 16 is disposed downstream of the printer 8 and, inter alia, functions to monitor/track the throughput of printed pages 12 being processed by the inserter 10. More specifically, the page buffer 16 receives printed pages 12 from the printer 8 and includes a plurality of sequential page stations 18*a*, 18*b*, 18*c*, 18*d*, 18*e* disposed along a serial feed path. Position sensing devices 20 are located at or along each of the page stations 18*a*, 18*b*, 18*c*, 18*d*, 18*e* and monitor the rate that printed pages enter or leave the page buffer 16. Furthermore, the sensing devices 20 are operative to issue position signals 22 to a system controller 24 such that the inserter 10 may determine whether a page or sheet 12 is positioned at a particular one of the page stations 18*a*, 18*b*, 18*c*, 18*d*, 18*e*. In the described embodiment, the sensing devices 20 are photocells, though any position sensor 20 may be employed.

The rate of change of the position signals 22 (i.e., the signals issued by the page buffer 16) may be used by the controller 24 to determine the throughput that content material is processed. Fundamentally, the "throughput" or "throughput rate" is the magnitude at which sheet material is processed, whether in terms of a steady number of "sheets per unit time", bundles of sheets (e.g., bundles of five (5) sheets requested every several seconds) or a non-steady flow of sheets. Generally, it is the objective of the system controller 24 to drive the printer 8 to generate content material 12 at a rate consistent, or commensurate, with the rate of processing by other downstream devices of the mailpiece creation system 10. While in the described embodiment the initial/first downstream device is a page buffer 16, it should be appreciated that any downstream device may be adapted to issue a throughput signal indicative of the rate that content material 12 or mailpieces are processed by the inserter 10. In FIG. 1, such downstream devices may additionally, or alternatively, include an accumulator 25, a pre-fold accumulator 26, a folder 27, an envelop inserter 28, and/or a sealer 29.

The system controller 24 monitors the throughput data and issues command signals 30 indicative of the number of pages 12 to be printed by the integrated printer 8. More specifically, the command signals 30 are indicative of a specific page number to begin printing along with the number of pages 12 to follow. For example, the controller 24 may issue command signals 30 requesting the printer 8 to generate page number thirty (Page #30) plus five (5) additional pages of data. Before this request is issued to the printer (in the more conventional sense), the controller 24 issues the command through a page-based language monitor 34. In the preferred embodiment, the system controller 24 generally issues a command signal 30 to print between three (3) to seven (7) pages with each request, though several command signals 30 may be generated within a very short period of time.

The mailpiece inserter 10 further includes a User Interface Module (UIM) 36 interposing the mechanical page buffer 16 and the system controller 24. The UIM 36 is responsive to the position signals 22 of the mechanical page buffer 16 for determining when additional pages, sheets or content material 12 can be accepted by the page buffer 16. Furthermore, the UIM 36 is operative to issue a request signal 38 to the system controller 24, which request signal 38 is indicative of the number of mailpiece content pages 12 to be printed. Hence, conversion of the position signals 22 to a command signal 30 may be performed by either the system controller 24 or by the UIM 36, depending upon where the program logic/intelligence is located. It should be further appreciated that while a request may be made by the UIM 36, the controller 24 may have received a message that the print job, i.e., determined at the User PC 14, is complete. Consequently, in this instance, the controller 24 will not forward a command signal 30 to the language monitor 34 for issuance to the printer 8.

The page-based language monitor 34 (hereinafter the "language monitor" or "LM") receives print stream data from a page-based print processor 40 and is interposed between the system controller 24 and the dedicated printer 8. In the broadest sense, the LM 34 is the gate-keeper of data communicated to the printer 8 from the controller 24. More specifically, the LM 34 retains material content data, including an object-data dictionary, for each page of material content and triggers the printer 8 to generate a particular page (i.e., page number) along with N number of additional pages. While this request to print is made by the controller 24, the LM 34 contains the active program code which intercepts the print stream data, i.e., the print control language (PCL), from the printer driver to throttle the rate at which content material 12 is generated by the printer 8.

More specifically, the page-based LM 34 is operative to vary the flow of print stream data to the printer 8 and vary the production rate of mailpiece content material. Additionally, the LM 34 includes a buffer file capable of storing 300 MB (300,000,000 bytes) of data and, accordingly, the buffer file is capable of storing multiple pages of data, including duplex pages. Hence, in the context used herein, a "page" of data includes all data which may be found on a one- or two-sided sheet of paper.

In operation, the language monitor 34 and print processor 40 issue a print command signal 44 to throttle/control the output of the printer in order to be consistent with or match the throughput of the mailpiece inserter 10. As more pages are processed by the inserter 10, additional or more frequent requests for additional printed pages can be made. Should the inserter 10 require additional processing time to collate and/or combine a complex variety of inserts, requests can be made for a fewer number of printed pages or at less frequent intervals to prevent an overload condition or too many sheets from being printed over a prescribed period of time.

Printer Integration/Print Interface

When integrating a printer with a sheet handling device such as a mailpiece creation system/inserter, several requirements and objectives should be met/obtained. First, to ensure maximum throughput, the system should minimize time gaps between a request for printing and the generation of printed content material. Secondly, to the extent that various application software may be employed to generate print jobs, it is desirable to affect integration of the printer without modifying its underlying print program code. As mentioned in the Background of the Invention, aside from the cost associated with program code modification, such program code is oftentimes proprietary to the original equipment manufacturer (OEM). Consequently, it may be difficult to obtain access to or overwrite the original program code.

Additionally, the printer throughput and/or operation should not be adversely impacted when performing specialized functions such as duplex printing. As will be discussed hereinafter, some printers feed duplex-printed pages to an upper output tray rather than to an accessory feed path. Inasmuch as certain sheet handling equipment, such as certain mailpiece inserters, receive printed pages from an accessory feed path, various control and/or feed path modifications must be performed without impacting throughput or creating new/additional modes of failure. Finally, inasmuch such high-output printers are costly pieces of capital equipment, it is oftentimes necessary that the printer be used in multiple modes to justify/amortize the original investment. Consequently, the printer may necessarily include a suitable interface to operate both independently and in conjunction with the sheet handling device. These requirements/objectives are discussed and met in the subsequent description.

Duplex Printing/Control Algorithm

Figure 3:
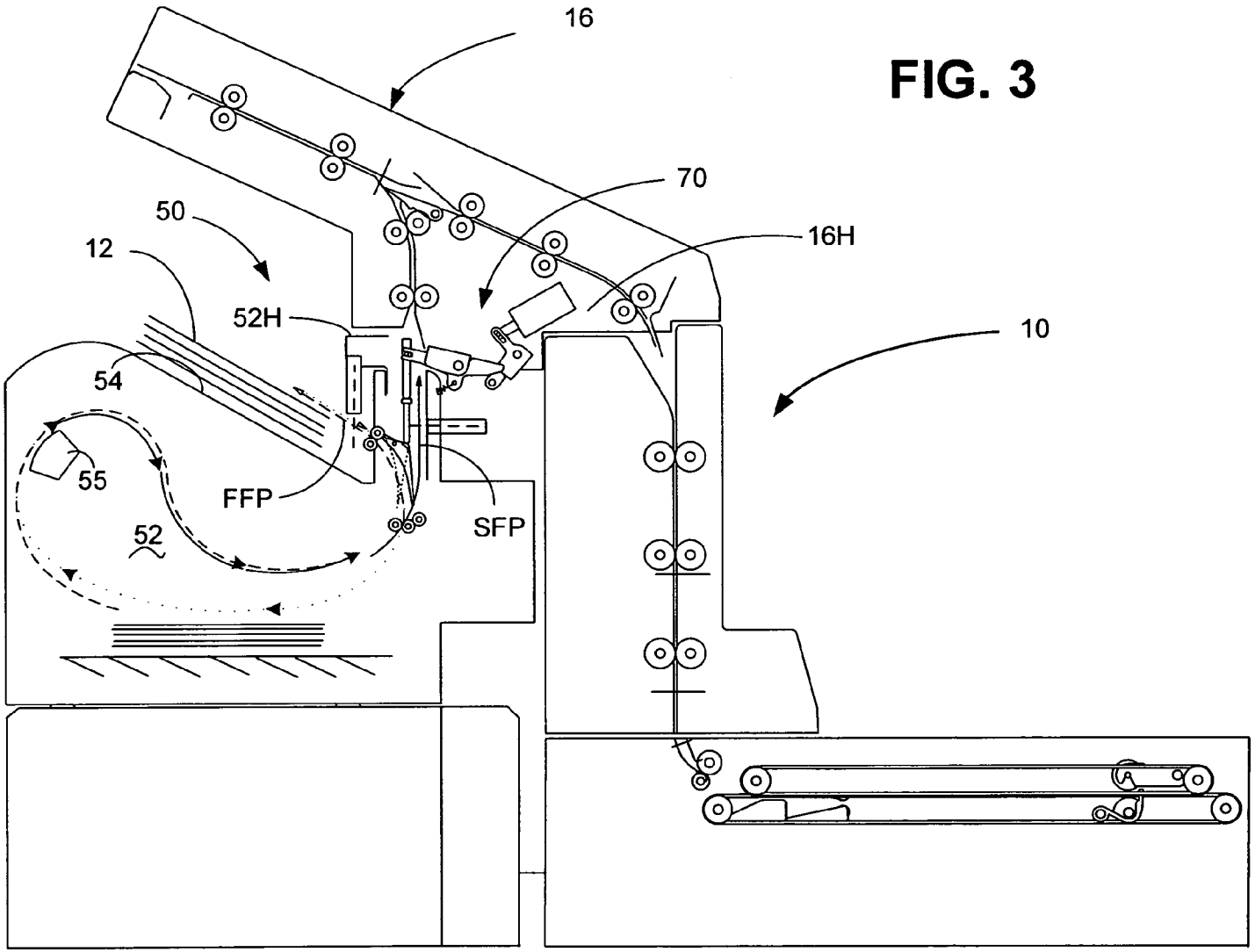
FIG. 3 is a broken-away side view of a print interface system in accordance with the teachings of the present invention, including a diverter and control mechanism for directing the feed path of duplex-printed content material.

To accommodate duplex printing, certain printers, such as the HP 4350 BW printer, feed duplex-printed pages to an output tray rather than to an accessory feed path. That is, these printers are preprogrammed by the OEM to feed duplex-printed pages to an upper output tray. In FIG. 3, an inventive print interface system 50 is shown including various structural/control modifications to address the challenges associated with duplex printing. More specifically, the print interface system 50 is disposed between a printer 52 and a mailpiece inserter 10. The printer 52 includes multiple feed paths FFP, SFP for feeding sheet material 12 to an upper output/staging tray 54 or to a page buffer 16 similar to that described in the preceding paragraphs. A first feed path FFP manipulates sheet material 12 internally of the printer 52 such that, following a first operation (denoted by dashed lines in FIG. 3), the sheets 12 are passed or staged to the upper staging tray 54. The first operation involves passing the sheet material 12 past a print head 55 for printing on a first face surface of the sheet material 12.

Following a brief period (typically a fraction of a second) in the staging tray 54, the sheet material 12 reverses direction and re-enters the printer 52 such that a second face of the sheet 12 may pass the print head 55 for printing on the reverse face of the sheet material 12 (i.e., an operation denoted by the dotted line in the FIG. 3), Even during the first print operation, other pages 12 are being handled/conveyed within the printer 52 such that several pages may pass the print head 55 to print on one face or an opposite face of the sheet 12. That is, to maximize throughput in the duplex printing mode, several sheets 12 may simultaneously be conveyed or handled internally of the printer 52. Furthermore, depending upon the sequence of print operations, two or more sheets may be printed on one face sheet before one of these same sheets is printed on its opposite face.

In view of the various print operations being performed while printing in the duplex mode, several difficulties must be understood and challenges overcome to ensure proper handling of the printed content material 12 at the print interface 50. For example, when the print interface system 50 is operative to feed sheets 12 to the mailpiece inserter 10, a second feed path SFP is established to forward printed content material to the page buffer 16. As a result, a controller or control algorithm must be employed to divert duplex pages to the page buffer 16 rather than to the upper tray 54. It will be recalled that the normal or preprogrammed print operation of the printer 52 calls for duplex-printed pages to be fed to the upper output tray.

Inasmuch as such duplex printed sheets 12 must be diverted to the mailpiece inserter 10 when producing mailpieces, the print interface system 50 includes a controllable/positionable diverter 56 having at least two positions. In a first position shown in FIG. 4*a*, sheets of material 12 are fed to the upper staging tray 54 in much the same manner as previously performed to reverse the direction of the sheets 12. That is, after printing on one face, the diverter 56 sends sheets 12, i.e., sheets which have now been printed on a single side, along the first feed path FFP to the upper staging tray 54. Following a second print operation associated with printing on the opposite face, the diverter 56 sends the sheets 12, i.e., sheets which have now been printed on both sides, along the second feed path SFP to the page buffer 16.

To acquire data/information concerning when a sheet 12 has passed various locations along the feed paths FFP, SFP, sheet sensors 60, 62 are located adjacent each of the paths FFP, SFP and orthogonal thereto to detect the presence or passage of a sheet 12. A first sheet sensor 60 is disposed proximal to a first printer opening 63, which outputs sheets 12 to the staging tray 54, and a second sheet sensor 60 is disposed immediately upstream of the diverter 56. More specifically, the first sheet sensor 60 optically detects the passage of the leading edge of a sheet 12 as it momentarily enters the staging tray 54 and subsequently reverses direction to re-enter the printer 52. The second sheet sensor 62 optically detects the passage of the trailing edge of a sheet 12 as it passes the diverter 56 into the page buffer 16 of the mailpiece inserter 10.

In operation, sheets of material 12 are printed on one side and are diverted to the upper staging tray 54. At this moment, the diverter 56 is spring-biased in a first direction, or to a position causing the sheets to follow the first feed path FFP, through the first printer opening 63 and past the first sensor 60. When the leading edge of each of the staged sheets 12 passes the optical beam 60B of the sensor 60, a staging signal 60S is issued to a controller 66 and an internal timer or clock 68 therein is set/started. Inasmuch as a plurality of sheets 12 may be staged into the tray 54 over the course of several seconds, many staging signals 64 may be issued, thereby setting several timers 68 within the controller 66. Inasmuch as the second print operation, i.e., the operation which prints on the opposing face of the duplex-printed sheet, consumes a fixed period of time X (in seconds), it can be concluded that any identified sheet 12 which was first detected X seconds prior, i.e., by the first sensor 60, has now been printed on both face surfaces. Accordingly, the identified sheet 12 is ready to be passed to the page buffer 16 of the mailpiece inserter 10.

Figure 4B:
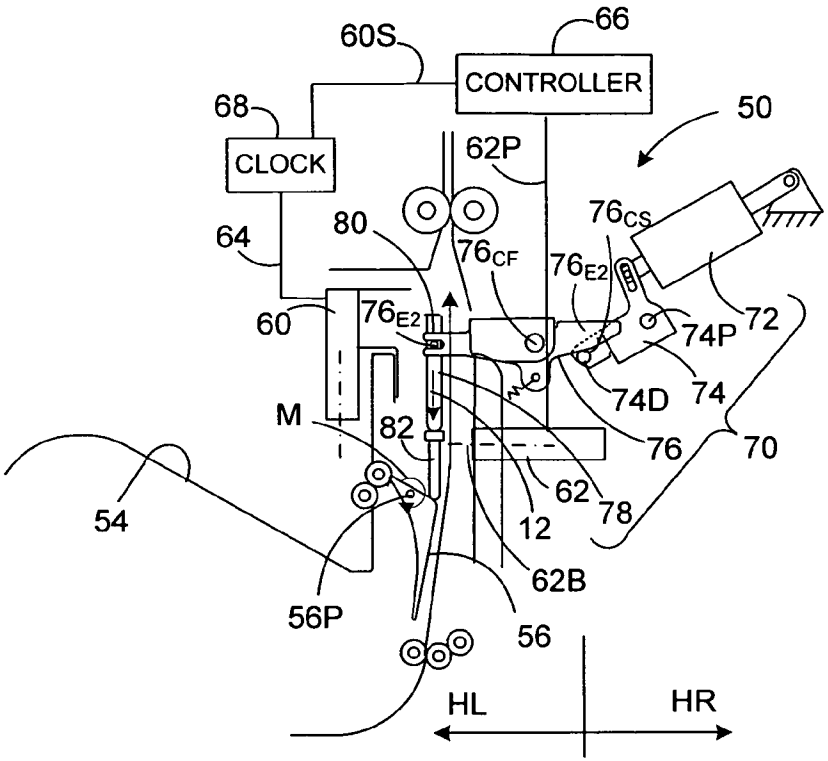
FIG. 4*b* is an enlarged view of the diverter in a second position for directing sheet material to the page buffer of the mailpiece inserter.
Figure 4A:
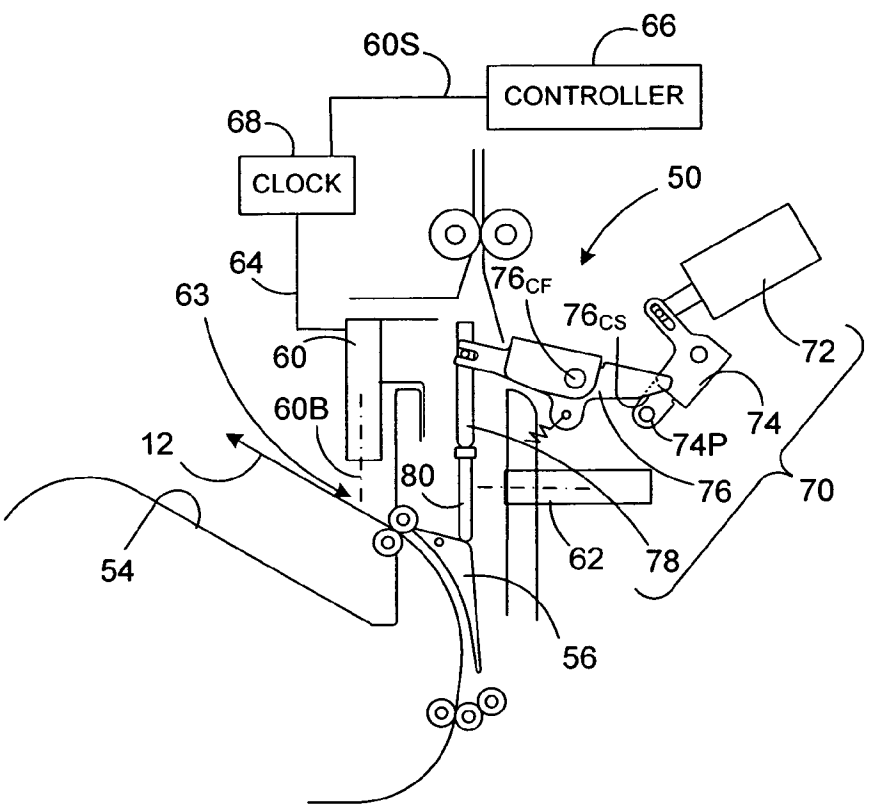
FIG. 4*a* is an enlarged view of the diverter in a first position for directing sheet material to an upper staging tray.

In FIGS. 4*a* and 4*b*, the controller 66 is responsive to the staging signal 60S issued by the first sensor to reposition the diverter 56 from a first position to a second position for directing sheets to the mailpiece inserter 10. Specifically, however, the controller 66 is operative to reposition the diverter 56 following a threshold period of time X from receipt of the staging signal. In the described embodiment, the threshold period X is between 3.0 to 4.0 seconds, and, more precisely, between about 3.3 to about 3.7 seconds.

To ensure that the diverter 56 remains in its second position for a period of time sufficient to permit passage of a duplex-printed sheet 12, the second sensor 62 issues a position signal 62P to the controller 66. That is, when the trailing edge of a sheet 12 passes the optical beam 62B of the second sensor 62, the controller 66 is responsive to the position signal 62P to rapidly reposition the diverter 56 from the second position to its original or first position. Accordingly, the first and second sensors 60, 62 communicate with the controller 66 to ensure that a duplex-printed page 12 is ready to be diverted to the page buffer 16 and has safely past the mechanism of the diverter 56.

Referring to FIGS. 3 and 4*b*, the print interface system 50 includes a mechanism 70 for actuating the diverter 56. Furthermore, the mechanism 70 is adapted to permit separation and/or disengagement of the printer 12 relative to the page buffer 16 of the mailpiece inserter 10. In the described embodiment, the mechanism 70 includes a linear actuator 72, a bell crank 74, a lever arm 76 and a plunger 78. More specifically, the linear actuator 72 and bell crank 74 are mounted to a housing structure 16H (see FIG. 3) of the page buffer 16 while the lever arm 76 and plunger 78 are affixed to a bridge structure 52H (FIG. 3), i.e., a structure bridging the output openings (i.e., staging and accessory output areas) of the printer 52.

Inasmuch as the diverter 56 is rotationally spring-biased to a first position, the mechanism 70 is adapted to overcome the spring bias force, thereby repositioning the diverter 56 to its second position, i.e., for directing sheet material 12 to the page buffer 16 of the mailpiece inserter 10. Upon receiving a command signal from the controller 66, the actuator 72 retracts linearly to pivot the bell crank 74 in a counterclockwise direction about a pivot point 74P. As the bell crank 74 pivots, a displacement device 74D, e.g., a cylindrical pin, follows an arcuate path to engage a cam surface 76CS at a first end $\mathbf{76}_{E1}$ of the lever arm 76. Inasmuch as the lever arm 76 is pivot mounted to the bridge structure 74 about a central fulcrum 76CF, the upward vertical motion of the pin 74P effects a downward vertical displacement of the lever arm 76 at its opposing second end $\mathbf{76}_{E2}$.

The downward displacement of the lever arm 76 is transferred to the plunger 78 by means of a slotted yoke/pin coupling 80 formed at the juncture of the second end $\mathbf{76}_{E2}$ of the lever arm 76 and the upper end of the plunger 78. Additionally, the downward motion of the plunger 78 is, in turn, transferred to an actuation pin 82 which engages the diverter 56. Finally, the actuation pin 82 engages a surface of the diverter 56 to effect a force couple or moment M about the pivot mount 56P of the diverter 56. The moment force M, therefore, alternately repositions the diverter 56 between its actuating or sheet diverting positions.

Inasmuch as the bell crank 74 and lever arms 76 are not positively coupled (i.e., the coupling-free interface defined by the interaction of a pin 74D and a cam surface $\mathbf{76}_{CS}$), these elements may be freely separated by the horizontal displacement of the printer 52 relative to the page buffer 16. That is, by separating the printer 52 and page buffer 16 horizontally, in the direction of arrows HL, HR, the print interface system 10 facilitates removal, replacement or repair of the printer 52 and/or printer components which may be accessible only by separating the components.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

The invention claimed is:

1. A print interface system for a sheet handling system, comprising:

a printer having multiple feed paths for printing on opposing surfaces of a sheet material, a first feed path directing sheet material to a staging tray and a second feed path directing sheet material to a downstream module of the sheet handling system;

a positionable diverter for directing sheet material to one of the first and second feed paths, a sheet sensor for determining when a sheet of material has been directed along the first feed path and issuing a staging signal indicative thereof;

a plurality of timers, each timer being responsive to a staging signal issued when the sheet sensor senses a leading edge of each sheet, and adapted to be set for each sheet conveyed internally of the printer, and a controller, responsive to the staging signal and setting each of the timers, for alternately repositioning the diverter from one of two positions, a first position for directing sheet material to the first feed path, and a second position for directing sheet material to the second feed path, the controller, furthermore, operative to reposition the diverter from the first to the second position following a threshold period of time from receipt of the staging signal.

2. The print interface system according to claim 1 wherein the threshold period of time is between about 3.0 to about 4.0 seconds.

3. The print interface system according to claim 1 wherein the threshold period of time is between about 3.3 to about 3.7 seconds.

4. The print interface system according to claim 1 wherein the second feed path defines a downstream position beyond the diverter and further comprises:

a sensor for determining when the sheet of material has passed the downstream position and issuing a position signal indicative thereof; and wherein the controller is responsive to the position signal to prevent repositioning of the diverter to the first position until the sheet of material has passed the downstream position.

5. The print interface system according to claim 1 wherein the staging tray is dually operative to stage sheet material for printing on opposing surfaces thereof and as an output tray for stacking sheet material.

6. The print interface system according to claim 1 wherein the downstream module is a page buffer of a mailpiece inserter.

7. The print interface system according to claim 1 wherein the sheet sensor optically senses a leading edge of the sheet material as each sheet of sheet material exits the printer from an output opening to the staging tray.

8. The print interface system according to claim 1 further comprising a mechanism for actuating the diverter and defining a coupling-free interface adapted to permit separation of the printer relative to the sheet handling system.

9. The print interface system according to claim 8 wherein the mechanism includes an actuator associated with the downstream module of the sheet handling device, a pivotable actuation lever disposed proximal to the diverter, the actuation lever having a cam surface at one end thereof and connecting to the diverter at the other end, and a displacement pin connecting to the actuator at one end and engaging the cam surface at the other end, wherein the cam surface and displacement pin define a separable interface to facilitate separation of the printer relative to the sheet handling system.

10. A method for interfacing a printer with a sheet handling system to perform duplex printing, the printer having multiple feed paths for printing on opposing surfaces of a sheet material and a diverter for directing the sheet material along each of the feed paths, a first feed path directing sheet material to a staging tray and a second feed path directing sheet material to a downstream module of the sheet handling system, the method comprising the steps of:

positioning the diverter to a first position to direct sheet material to the first feed path when duplex printing sheet material;

sensing when a sheet of material has been directed along the first feed path and issuing a staging signal indicative thereof;

setting multiple timers, in response to receipt of staging signals from multiple sheets, for monitoring multiple sheets of content material being conveyed internally of the printer; and repositioning the diverter to a second position after a threshold period has elapsed from the timer being set, the second position of the diverter directing sheet material to the second feed path.

11. The method according to claim 10 wherein the threshold period of time is between about 3.0 to about 4.0 seconds.

12. The method according to claim 10 wherein the threshold period of time is between about 3.3 to about 3.7 seconds.

13. The method according to claim 10 wherein the feed path to the downstream module of the sheet handling system defines a downstream position beyond the diverter and further comprising the steps of:

sensing when the sheet material has passed the downstream position and issuing a position signal indicative thereof; and repositioning the diverter from the second to the first position in response to the position signal.

14. A mailpiece inserter comprising:

a printer operative to print sheet material and having multiple feed paths for printing on opposing surfaces of the sheet material, the printer including a staging tray, a page buffer operative to receive the sheet material from the printer; and a print interface system operative to integrate the printer with the page buffer, the print interface system including:

a positionable diverter for directing sheet material to one of two feed paths, a first feed path directing the sheet material to a staging tray and a second feed path directing the sheet material to the page buffer;

a sheet sensor for determining when the sheet material has been directed along the first feed path and issuing a staging signal indicative thereof; and a controller, responsive to the staging signal, for alternately repositioning the diverter from one of two positions, a first position for directing sheet material to the first feed path, and a second position for directing sheet material to the second feed path, the controller, furthermore, operative to reposition the diverter from the first to the second position following a threshold period of time from receipt of the staging signal.

15. The mailpiece inserter according to claim 14 further comprising a timer, and wherein the sheet sensor starts the timer upon sensing a leading edge of the sheet material and wherein the controller determines the threshold period of time based upon input from the timer.

16. The mailpiece inserter according to claim 15 further comprising multiple timers, each timer associated with individual sheets of the sheet material which are conveyed internally of the printer.

17. The mailpiece inserter according to claim 15 wherein the threshold period of time is between about 3.0 to about 4.0 seconds.

18. The mailpiece inserter according to claim 14 wherein the threshold period of time is between about 3.3 to about 3.7 seconds.

19. The mailpiece inserter according to claim 14 wherein the second feed path defines a downstream position beyond the diverter and further comprises:

a sensor for determining when the sheet of material has passed the downstream position and issuing a position signal indicative thereof; and wherein the controller is responsive to the position signal for repositioning of the diverter from the second position to the first position when the sheet of material has passed the downstream position.

20. The mailpiece inserter according to claim 14 wherein the staging tray is dually operative to stage sheet material for printing on opposing surfaces thereof and as an output tray for stacking sheet material.

* * * * *